US007607825B2

(12) United States Patent
Koschack et al.

(10) Patent No.: US 7,607,825 B2
(45) Date of Patent: Oct. 27, 2009

(54) METHOD AND APPARATUS FOR MONITORING THE FORMATION OF DEPOSITS IN FURNACES

(75) Inventors: Ralf Koschack, Velgast (DE); Günter Hoven, Mönchengladbach (DE); Bernhard Sobotta, Much (DE)

(73) Assignee: CMV Systems GmbH & Co. KG (DE)

( * ) Notice: Subject to any disclaimer, the term of this patent is extended or adjusted under 35 U.S.C. 154(b) by 606 days.

(21) Appl. No.: 11/512,429

(22) Filed: Aug. 29, 2006

(65) Prior Publication Data

US 2008/0298426 A1 Dec. 4, 2008

(30) Foreign Application Priority Data

Aug. 29, 2005 (DE) ..... 10 2005 041 004

(51) Int. Cl.

| | |
|---|---|
| ***G01K 13/00*** | (2006.01) |
| ***G01K 3/00*** | (2006.01) |
| ***G01N 25/00*** | (2006.01) |
| ***G01J 5/00*** | (2006.01) |

(52) U.S. Cl. ..... 374/7; 374/121; 374/141; 374/137; 374/124; 374/147

(58) Field of Classification Search ..... 374/7, 374/121, 141, 137, 124, 147
See application file for complete search history.

(56) References Cited

U.S. PATENT DOCUMENTS

| | | | | |
|---|---|---|---|---|
| 5,110,365 | A | 5/1992 | Carter | |
| 5,368,472 | A * | 11/1994 | Hovis et al. | 431/115 |
| 5,462,358 | A * | 10/1995 | Werner | 374/124 |
| 2003/0230717 | A1 | 12/2003 | Reilly et al. | |
| 2008/0253430 | A1 * | 10/2008 | Ekman et al. | 374/166 |

FOREIGN PATENT DOCUMENTS

| | | |
|---|---|---|
| AT | 40 71 97 | 1/2001 |
| DE | 3414694 A1 * | 10/1985 |
| DE | 281 448 | 9/1996 |
| DE | 195 47 269 | 6/1997 |
| DE | 196 40 337 | 3/1998 |
| DE | 103 48 013 | 5/2005 |
| EP | 1 347 327 | 9/2003 |
| JP | 59 025118 | 3/1984 |
| JP | 59 049420 | 3/1984 |

OTHER PUBLICATIONS

"Get Smart About Removing Slag" Ken Wicker.
"Implementation of Intelligent Sootblowing" Sandeep Shah, P.E and Charlie Breeding. P. E. Clyde Bergmann, Inc.

* cited by examiner

*Primary Examiner*—Gail Verbitsky
*Assistant Examiner*—Mirellys Jagan
(74) *Attorney, Agent, or Firm*—Robert W. Becker; Robert W. Becker & Assoc.

(57) ABSTRACT

Method and apparatus for monitoring formation of deposits of solid particles from flue gas onto furnace walls formed of welded-together tubes through which cooling medium flows. For the entire surface of the walls, the exact surface temperature is detected with infrared cameras, offset by 90° relative to one another, via a thermal image obtained of a surface development of the furnace. This exact surface temperature is compared with the temperature of the cooling medium from measurement locations. Individual images from the cameras are composed to form an overall development of the inner surface of the furnace walls. The coordinates of the deposits on the walls are determined from the overall development, and the thickness of the deposits is determined from the temperature comparison.

8 Claims, 2 Drawing Sheets

METHOD AND APPARATUS FOR MONITORING THE FORMATION OF DEPOSITS IN FURNACES

Figure 1:
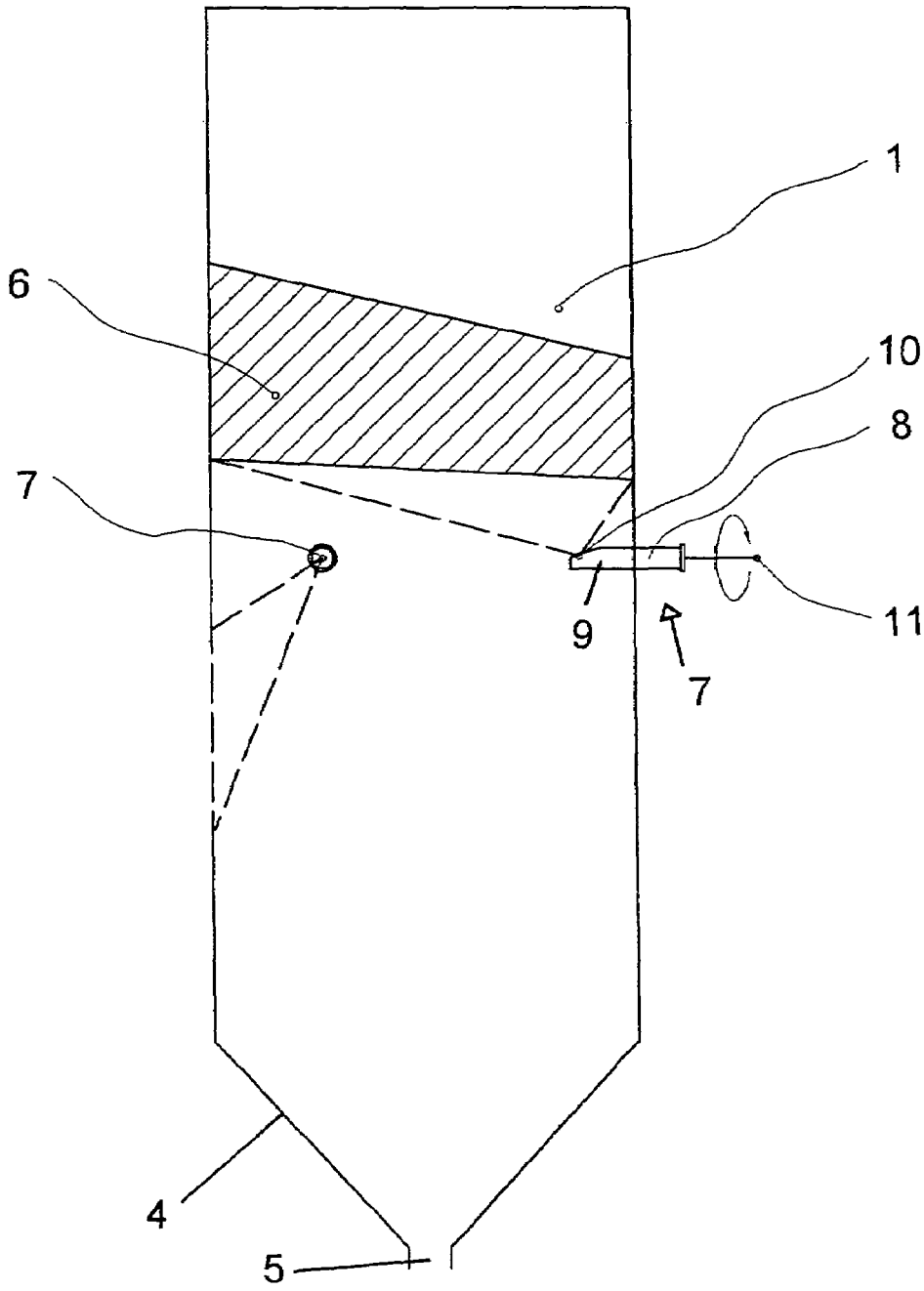

The instant application should be granted the priority date of Aug. 29, 2005, 2005 the filing date of the corresponding German patent application 10 2005 041 004.9.

BACKGROUND OF THE INVENTION

The invention relates to a method and apparatus for monitoring the formation of deposits caused by depositions of solid particles from a hot, dust-laden flue gas onto the walls of a rectangular furnace of a boiler by taking an infrared image of the walls with the aid of an infrared camera, wherein the walls are formed by tubes that are tightly welded together and through which a cooling medium flows.

When boilers are fired with solid fuel, on the flue gas side deposits are formed on the heating surfaces due to the deposition of solid particles, for example ash. Due to their heat-insulating effect, such deposits on the heating surfaces hinder the transfer of heat from the flue gas to the working medium (water/water vapor) in the tubular walls of the heating surfaces, thus reducing the efficiency of the boiler.

In the region of the furnace, the deposits are cleaned off by means of high pressure water streams of water or water lance blowers. In this connection, it is desired on the one hand to clean off the deposits as completely as possible, and on the other hand to prevent the water stream from striking clean heating surface regions. The latter leads to an unnecessary stressing of the material of the tubular walls of the heating surfaces as a consequence of thermal shock and the thereby resulting damage to the boiler. A further desire is to have to clean only as often as necessary in order to avoid efficiency losses due to the cleaning process. To control the cleaning devices in the furnace, the following methods are used pursuant to the present state of the art:

a) Time Control:

Based on experience data, the entire furnace is cleaned after fixed time intervals have elapsed. In this connection, neither the deposits that are formed are attacked in a selective manner nor are areas that have remained cleaned spared.

b) Heat-Type Diagnosis of the Heat Transfer Capability of the Heating Surfaces:

By measuring entry and exit parameters of the working medium, the reduction of the heat transfer of the heating surfaces is diagnosed and the cleaning process is initiated. The heating surfaces arranged in the furnace belong to the most part to the evaporator, which from a thermal standpoint can only be diagnosed as a whole. Thus, cleaning of the entire evaporator heating surface is always initiated, without sparing clean areas.

c) Localization of Deposits via Heat-Flux Density Probes Welded into the Heating Surfaces:

The heat-flux from the flue gas to the working medium is measured in a point-focal manner, and the heating surfaces are cleaned by sections based upon the measured data. This enables contaminated regions to be cleaned in a selective manner while sparing clean regions. However, the installation and maintenance of the heat-flux density probes is very complicated and expensive. Therefore, only few measurement locations are installed, so that each measurement point involves several hundred square meters of heating surface. Thus, it is not possible to ensure that the point-focal measurement is representative of the associated heating surface region, i.e. the predominant portion of the region can, for example, be clean, although the point-type measurement indicates contamination.

d) Localization of Deposits with Infrared Camera Systems:

It is known to use infrared camera systems to evaluate the degree of contamination of heating surfaces, and by computer-supported evaluation of the infrared images to determine the geometrical extent of the deposits (DE 195 47 269 A1). In accordance with an evaluation, the deposits are removed by a shock generator. To carry out the known method, the infrared cameras are disposed in hatches and inspection flaps of the flue for flue gas that is disposed downstream of the furnace and accommodates contact heating surfaces. No details are provided in DE 195 47 269 A1 about the configuration of the infrared cameras and the evaluation of the measurement results.

With the method known from DE 41 39 738 C2, an infrared image of the walls of the furnace of a boiler is taken with the aid of an infrared camera. The infrared camera that is utilized operates in the near infrared range at a wavelength of from 1.5 to 2.1 μm. The known method can be used only for ash deposits having a high degree of reflection. The method furthermore presupposes a reference region on the furnace wall that is not to be cleaned. The intensity ratio between the region that is to be cleaned and the reference region is the measure for the contamination of the region that is to be cleaned. Thus, it is not possible to completely clean the entire wall.

It is an object of the invention to make the monitoring of the formation of deposits upon the walls of furnaces with the aid of infrared cameras simpler and universally usable.

SUMMARY OF THE INVENTION

The method of the present application provides two infrared cameras that are offset by 90° relative to one another; over the entire surface of the walls of the furnace, the exact surface temperature is detected with the infrared cameras via a thermal image obtained of a surface development of the furnace; the detected exact surface temperature is compared with the temperature of the cooling medium known at respective measurement locations, taking into consideration the thickness and thermal conductivity of the tubes of the walls of the furnace; individual images taken by each of the cameras are composed to form an overall development of the walls of the inner surface of the furnace; the coordinates of the deposits on the walls are determined from the overall development; and the thickness of the deposits on the walls is determined from the temperature comparison.

The apparatus of the present application for carrying out the inventive method comprises at least one of the infrared cameras in each of two adjacent walls of the rectangular furnace, wherein each camera is rotatable in a stepwise manner by 360° about its longitudinal axis and is provided with an oblique objective lens, wherein each camera has a predetermined rake angle of the oblique objective lens in conjunction with the angle of image of the camera, and wherein each camera detects the entire width of a wall of the furnace for an image composition, image processing and image evaluation.

Due to their heat-insulating effect, the heating surface contaminations have a higher surface temperature than do uncontaminated heating surfaces, and can therefore be localized in a well-defined manner in a thermal image, and their thickness can be qualitatively valued. At a preferred wavelength lying in the middle infrared range of 3.9 μm, the furnace atmosphere, which is made cloudy by solid particles and above all contains substituents such as $H_2O$ and $CO_2$ that absorb infrared radiation, has its maximum possible transparency, which makes it possible to recognize the furnace walls.

One embodiment of the invention, which will be described in detail subsequently, is illustrated in the drawing, in which:

FIG. 1 schematically shows a side view of a furnace; and

Figure 2:
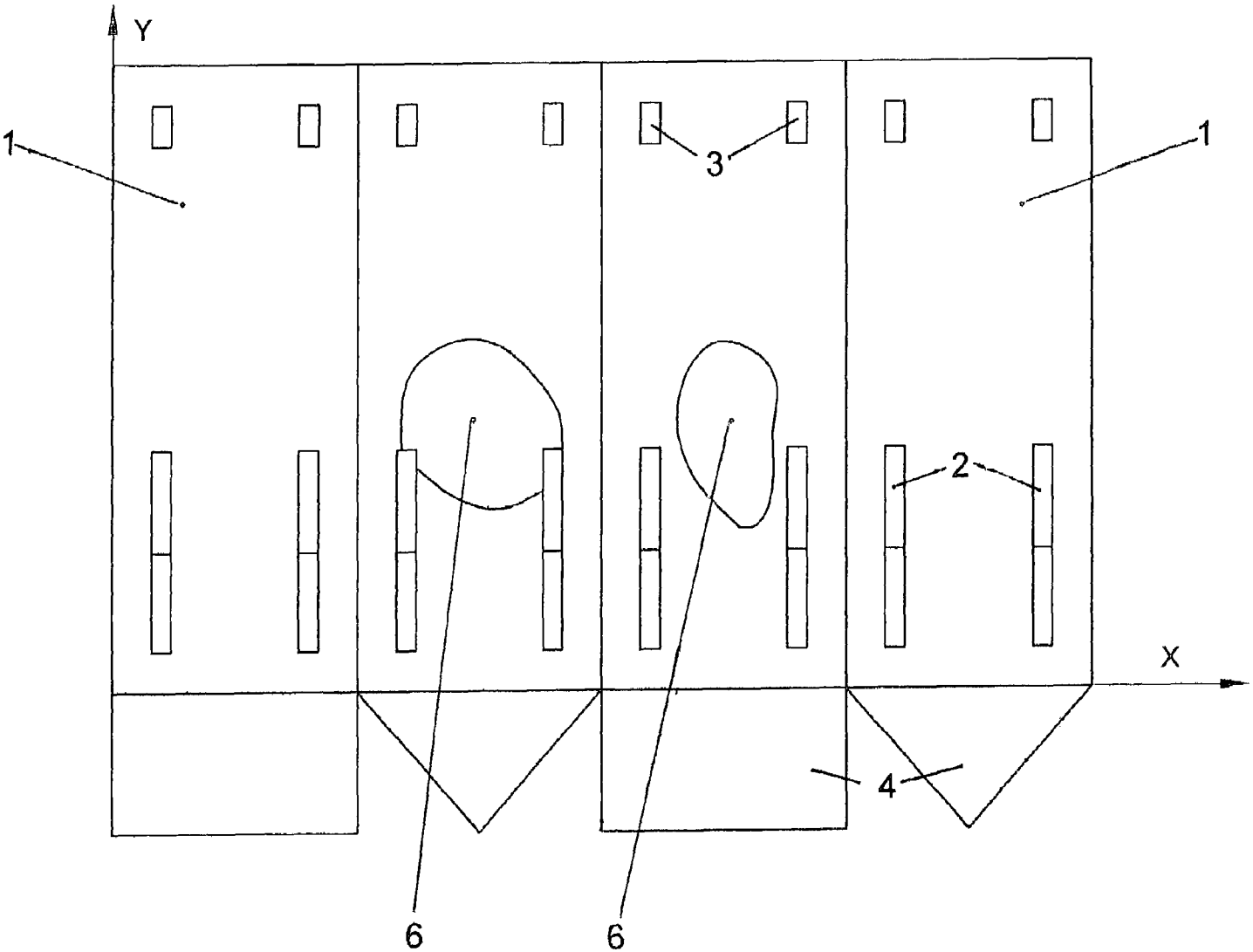

FIG. 2 shows the developed view of the furnace of FIG. 1;

DESCRIPTION OF SPECIFIC EMBODIMENTS

The combustion chamber or furnace of a power plant boiler fired with coal dust is delimited by walls 1 in which are provided burner openings 2 for receiving burners as well as openings 3 for the discharge of the secondary air. The walls 1 of the furnace are composed of tubes that are welded together in a gas tight manner by ribs or fins. The furnace has a rectangular cross-section, and ends in a funnel 4 having a discharge slot 5 for the removal of ash. At the upper end, the furnace merges with a non-illustrated flue for flue gas. The tubes of the walls 1 of the furnace act as evaporators, and water and water vapor flow through them as working or cooling medium.

A portion of the solid particles that remain behind upon combustion of the coal dust are carried along by the flue gas that rises in the furnace. Depending upon the quantity and composition of the solid particles, more or less large surfaces of deposits or incrustations 6 form on the inner side of the walls 1 due to deposition of solid particles from the flue gas. Since such deposits 6 have a thermal insulating effect, and adversely affect the transfer of heat from the flue gas to the cooling medium flowing in the tubes of the walls 1, the walls 1 are cleaned off with the aid of water blowers or water lance blowers, or by other cleaning systems, and are thereby freed of the deposits 6. In order to precisely remove the deposits 7 to protect the walls 1, the infrared camera system that will be described subsequently is utilized.

A respective infrared camera 7 is installed in each of two adjacent walls 1 of the rectangular furnace, i.e. in walls 1 that are disposed at right angles to one another. The two infrared cameras 7 are combined to form an assembly. The infrared cameras 7 operate in the middle infrared range with a wavelength of 3 to 5 μm. A wavelength of 3.9 μm is preferably selected since for the infrared radiation with this wavelength the optimum transparency in the furnace atmosphere is achieved.

Infrared cameras suitable for use in furnaces are known from EP 1 347 325 A1. They are comprised of an objective or lens body 8, an inversion system, and an objective or lens head 9 that extends into the interior of the furnace. The lens head is provided with an oblique objective lens 10.

The lens head 9 and the inversion system each contain a lens system that, depending upon the location of use and the application, can have different image angles (wide angle or normal lens). As indicated in FIG. 1 by the dashed lines, the angle of inclination of the oblique objective lens 10 and/or of the image angle of the lens system is selected such that the infrared camera 7 can detect the entire width of a wall 1. Depending upon the size of the wall 1, it would also be possible to install a plurality of infrared cameras 7 above or next to one another in a wall 1.

Each infrared camera 7 is rotatable about its longitudinal axis 11 by 360°. Upon rotation of the two infrared cameras 7 that are combined to form an assembly, respectively two oppositely disposed walls 1, and hence overall the inner surface of the furnace, can be entirely detected. The two infrared cameras 7 thus working together provide a thermal image or temperature-entropy diagram of all walls 1 of the furnace.

The infrared camera system described operates in the following manner. The infrared cameras 7 are controlled and rotated in a defined manner in steps via a commercial, non-illustrated central unit. In each position, over a specific time span, at infrared film is stored in the commercial, non-illustrated central unit.

By means of a conventional electronic image processing in the non-illustrated central unit, a thermal image having the best-possible image-reproduction quality of the walls 1 of the furnace is obtained from the infrared films. In this connection, the radiation influence of the solid particles contained in the flue gas is to be eliminated as follows:

The openings 3 for the discharge of the secondary air do not become fouled at the openings 3 and have a known, constant temperature. The apparent temperature at the openings 3 for the discharge of the secondary air is measured in the thermal image. From the known actual temperature, and the temperature measured in the thermal image, the magnitude of the radiation influence of the solid particles contained in the flue gas is determined by the non-illustrated central unit on the basis of a conventional mathematical/physical radiation model of solid particles in the flue gas. With the aid of the mathematical/physical radiation model and the determined parameters, for each image point the radiation influence of the solid particles contained in the flue gas is determined and is eliminated by the non-illustrated central unit.

The thermal image that is obtained is geometrically rectified or corrected in the central unit and is composed in the coordinate system XY (FIG. 2) in a coordinate-precise manner to form a surface development of the walls 1 of the furnace. The composed thermal image of the surface development is then substantially free of the radiation influence of the solid particles of the flue gas.

The thermal transfer between flue gas and the walls 1 of the heating surfaces of the fire box is effected by thermal radiation. The heat-flux density in kilowatts per square meter is thereby defined as the hemispherical radiation that strikes a surface of the wall of the furnace. The heat-flux density is a function of the temperature and the composition of the flue gas. In this connection, the heat-flux density varies over the height of the furnace and with changing operating conditions of the firing.

The thermal image of the surface development that is obtained reproduces the existing surface temperature of the walls 1 of the furnace. From the manner of operation and the construction of the furnace, the temperature of the cooling medium that is flowing in the tubes of the wall 1 of the furnace, as well as the wall thickness of the tubes and the thermal conductivity of the tube material, are known. From the known prescribed values, it is possible, at a pre-determined heat-flux density in kilowatts per square meter, to determine the surface temperature and the heat-flux, of a wall 1 that is free of deposits 6, transmitted to the cooling medium taking into consideration the thermal transfer. The surface temperature, which is then measured in a conventional manner at an arbitrary location, is compared in the non-illustrated central unit with the determined surface temperature of a wall 1 that is free of deposits 6. After the comparison is completed, the thermal image is an indication of the position of the deposit 6 on the walls 1 of the furnace, and of a qualitative value of the thickness of the established deposits as a result of their heat-insulating effect.

The surface temperature measured at any location of the inner surface of the wall 1 of the furnace is used, at a predetermined heat-flux density, temperature of the cooling medium that is flowing in the tubes of the walls 1 of the furnace, thickness of the tubes, and thermal conductivity of the tube material, with the aid of known physical principles, to determine the heat-flux transmitted to the cooling medium with the help of the non-illustrated central unit. The thus-determined, transmitted heat-flux is related to the heat-flux that the wall 1, free of deposits 6, would transmit at the same point in time to the cooling medium. The heat-fluxes that have been related to one another form the so-called heating surface weight, which lies between zero and one.

With the heating surface weights that are determined, the non-illustrated central unit enables a cleaning system to clean the deposit 6 from the walls 1 in a precise manner and with an intensity that is adapted to the thickness of the deposits.

To determine the heating surface weights, it is necessary to know the heat-flux density, namely the hemispherical radiation, in kilowatts per square meter, that strikes a surface of the furnace wall. In this connection, the determination of the heat-flux density is possible by two different methods, which are employed as a function of the structural configuration of the furnace or alternatively in combination with one another.

Method 1:

For each defined operating state of the boiler, the heat-flux density is measured with a known portable measuring probe at several points of the furnace wall during operation of the infrared camera system. An interpolation takes place between the measurement points. The determined distribution of the heat-flux density over the wall 1 of the furnace is registered in the computer of the non-illustrated central unit for each operating state. During operation of the infrared camera system, data is electronically transferred to the computer from the process conductance system of the boiler. The identification of the actual operating state is effected with the aid of the transferred operating data. The distribution of the heat-flux density over the walls 1 of the furnace registered for the actual operating state is utilized for determining the heating surface weights.

Method 2:

In the wall 1 of the furnace are small-surfaced areas that are not formed by tubes through which cooling medium flows but rather by masonry that is not cooled. The heat-flux in the small-surfaced areas that passes through the wall 1 of the furnace is relatively small. From the surface temperature measured during operation of the infrared camera system from such an area, the position of which is known, via the infrared camera, it is thus possible, with the aid of known physical principles, to determine the heat-flux density that strikes this area. Between the small-surfaced and uncooled areas, which serve as measurement points, an interpolation takes place, so that the distribution of the heat-flux density over the wall 1 of the furnace is determined directly from the thermal image of the surface development, and is used for determining the heating surface weights.

During the determination of the heating surface weights, the degree of the emission of the deposits 6 of the walls 1, which changes with time and is known to only a limited preciseness, enters as a magnitude of error into the determination of the heating surface weights. Since the uncooled areas that are used to determine the heat-flux density pursuant to Method 2 are covered with deposits 6 of the same type, and hence with the same degree of emission, as are other areas of the walls 1 of the furnace, the error caused during the determination of the heat-flux density pursuant to Method 2 by the degree of emission is for the most part compensated for by the error caused during the determination of the heating surface weights by the degree of emission. When Method 2, or a combination of Methods 1 and 2, is used to determine the heat-flux density, the error of the degree of emission of the deposits 6 on the wall 1 that varies with time and is known to only a limited degree of preciseness thus has an only slight influence upon the determination of the heating surface weights.

The specification incorporates by reference the disclosure of German priority document 10 2005 041 004.9 filed 29 Aug. 2005.

The present invention is, of course, in no way restricted to the specific disclosure of the specification and drawings, but also encompasses any modifications within the scope of the appended claims.

We claim:

1. A method of monitoring formation of deposits caused by depositions of solid particles from a hot, dust-laden flue gas onto walls of a rectangular furnace of a boiler, wherein said walls are formed of tubes that are tightly welded together and through which a cooling medium flows, said method including the steps of:

providing two infrared cameras that are offset by 90° relative to one another;

detecting, over the entire surface of said walls of said furnace, the exact surface temperature with said infrared cameras via a thermal image obtained of a surface development of said furnace;

comparing the detected exact surface temperature with the temperature of the cooling medium known at respective measurement locations, taking into consideration the thickness and the thermal conductivity of said tubes of said walls of said furnace;

comparing individual images taken by each of said infrared cameras to form an overall development of said walls of the inner surface of said furnace;

determining the coordinates of said deposits on said walls from said overall development; and determining the thickness of said deposits on said walls from the temperature comparison.

2. A method according to claim 1, wherein said coordinates and said thickness of said deposits on said walls are conveyed to a cleaning system for a precise and intensive removal of said deposits.

3. A method according to claim 1, wherein a radiation influence of the solid particles contained in the flue gas is determined and eliminated with a mathematical/physical radiation model and the determined parameters for each image point.

4. A method according to claim 1, wherein a heat-flux density that strikes each point of said walls of said furnace is determined.

5. A method according to claim 1, wherein said step of detecting the exact surface temperature is carried out in the middle infrared range of 3.0 to 5.0 μm.

6. A method according to claim 5, wherein said step of detecting the exact surface temperature is carried out at a wavelength of 3.9 μm.

7. An apparatus for carrying out the method of claim 1, comprising:

at least one of said infrared cameras in each of two adjacent walls of said rectangular furnace;

wherein each infrared camera is rotatable in a stepwise manner by 360° about its longitudinal axis and is provided with an oblique objective lens;

wherein each of said infrared cameras has a predetermined rake angle of said oblique objective lens in conjunction with the angle of image of said infrared camera; and wherein each of said infrared cameras detects the entire width of a wall of said furnace for an image composition, image processing and image evaluation.

8. An apparatus according to claim 7, wherein said infrared cameras are disposed in the walls of said furnace offset by 90° relative to one another.

* * * * *